US008546558B2

(12) United States Patent
Ankerfors et al.

(10) Patent No.: US 8,546,558 B2
(45) Date of Patent: Oct. 1, 2013

(54) METHOD FOR THE MANUFACTURE OF MICROFIBRILLATED CELLULOSE

(75) Inventors: Mikael Ankerfors, Stockholm (SE); Tom Lindström, Sollentuna (SE); Gunnar Henriksson, Solna (SE)

(73) Assignee: STFI-Packforsk AB, Stockholm (SE)

( * ) Notice: Subject to any disclaimer, the term of this patent is extended or adjusted under 35 U.S.C. 154(b) by 950 days.

(21) Appl. No.: 12/161,463

(22) PCT Filed: Jan. 31, 2007

(86) PCT No.: PCT/SE2007/000082

§ 371 (c)(1), (2), (4) Date: Nov. 12, 2008

(87) PCT Pub. No.: WO2007/091942

PCT Pub. Date: Aug. 16, 2007

(65) Prior Publication Data

US 2009/0221812 A1 Sep. 3, 2009

(30) Foreign Application Priority Data

Feb. 8, 2006 (SE) ..... 0600272

(51) Int. Cl.
*C08B 1/00* (2006.01)
*D21B 1/04* (2006.01)

(52) U.S. Cl.
USPC ..... 536/56; 162/24; 162/28

(58) Field of Classification Search
USPC ..... 536/56; 162/24, 28
See application file for complete search history.

(56) References Cited

U.S. PATENT DOCUMENTS 4,341,807 A 7/1982 Turbak et al.

FOREIGN PATENT DOCUMENTS

| | | | |
|---|---|---|---|
| JP | 06-010288 | A | 1/1994 |
| JP | 07-189156 | A | 7/1995 |
| JP | 08-109591 | A | 4/1996 |
| JP | 09-059301 | A | 3/1997 |
| JP | 2000-017592 | A | 1/2000 |
| JP | 2000-504939 | A | 4/2000 |
| JP | 2002-180397 | A | 6/2002 |
| JP | 2003-201690 | A | 7/2003 |
| JP | 2005-042296 | A | 2/2005 |
| WO | 97-27363 | A1 | 7/1997 |
| WO | 01/66600 | A1 | 9/2001 |
| WO | 2004/055267 | A1 | 7/2004 |
| WO | 2004/101889 | A2 | 11/2004 |

OTHER PUBLICATIONS

Henriksson et al., J. Ind. Microbiol. Biotechol. (2005) 32, 211-214.*
Henriksson et al., "Cellulose Nanocomposite Films—Processing, Structure and Properties," Stockholm. Royal Inst. Tech., Paper B. pp. 1-11 (2004).
Engström at al., "Improved Accessibility and Reactivity of Dissolving Pulp for the Viscose Process: Pretreatment with Monocomponent Endoglucanase," Blomacromolecules, vol. 7, pp. 2027-2031 (2006).
Novozymes: Analytical Method, Determination of Endo-Cellulase Activity Using CMC Vibration Viscometry (ECU), SOP No. EB-SM-0302.02/01, pp. 1-14.
Genencor International, Multifect A40, Cellulases and Hemicellusases for Fiber Modification, pp. 1-2.
Japanese Office Action, dated Aug. 16, 2011, from corresponding application No. JP2008-554183.
Japanese Office Action, dated Mar. 27, 2012, from corresponding application No. JP2008-554183.

* cited by examiner

*Primary Examiner* — Chih-Min Kam
(74) *Attorney, Agent, or Firm* — Young & Thompson

(57) ABSTRACT

A method of treating chemical pulp for the manufacture of microfibrillated cellulose includes the following steps: a) providing a hemicellulose containing pulp, b) refining the pulp in at least one step and treating the pulp with one or more wood degrading enzymes at a relatively low enzyme dosage, and c) homogenizing the pulp thus providing the microfibrillated cellulose. A microfibrillated cellulose obtainable by the method is also provided. The microfibrillated cellulose can be used in food products, paper products, composite materials, coatings or in rheology modifiers (e.g. drilling muds).

19 Claims, 1 Drawing Sheet

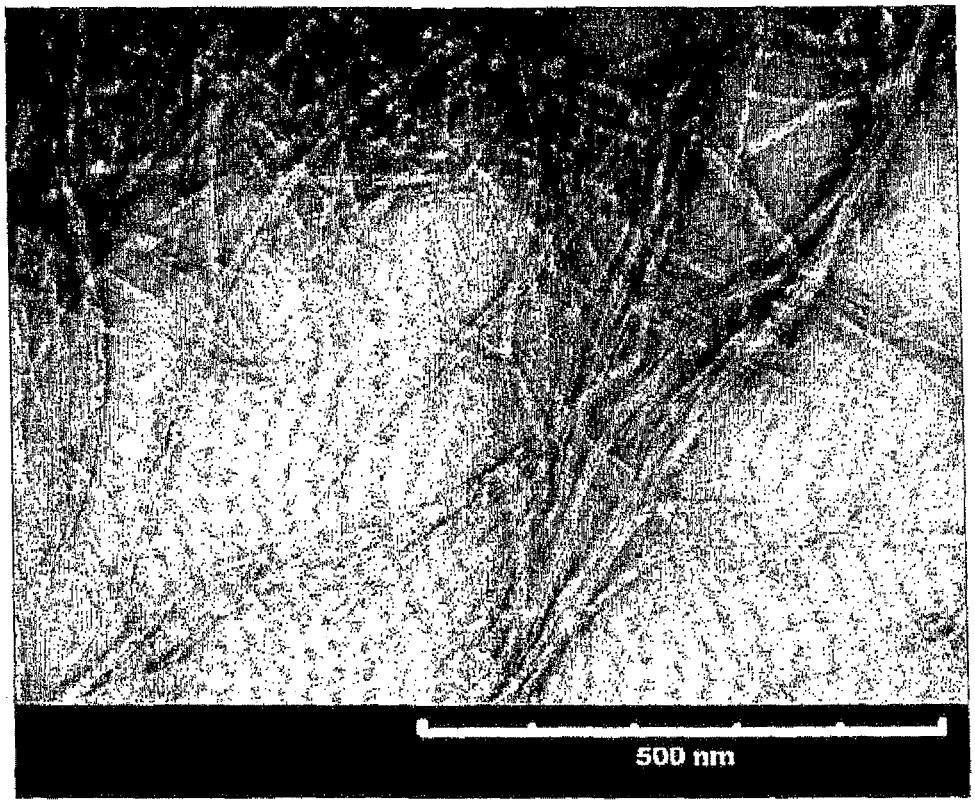
500 nm

METHOD FOR THE MANUFACTURE OF MICROFIBRILLATED CELLULOSE

This application is a U.S.C. 371 national stage of International application PCT/SE07/000,082 filed on Jan. 31, 2007, the entire contents of which is hereby incorporated by reference.

FIELD OF THE INVENTION

This invention concerns the technical field of pulp treatment for the manufacturing of microfibrillated cellulose. Also disclosed is a microfibrillated cellulose manufactured in accordance with said method and uses of said cellulose.

BACKGROUND

Through U.S. Pat. No. 4,341,807 a method for manufacturing a microfibrillated cellulose is disclosed by using homogenization. The method is facilitated by adding a hydrophilic polymer.

A problem when manufacturing microfibrillated cellulose from pulp is the clogging of the pulp, when the pulp is pumped through high pressure fluidizers/homogenizers. Thus there is a need for a process wherein this clogging problem can be alleviated and/or avoided. A further problem when manufacturing microfibrillated cellulose from pulp is the high energy consumption and accordingly there is a need for a process wherein high energy consumption can be avoided.

SUMMARY OF THE INVENTION

The present invention solves the above problems by providing according to a first aspect of the invention a method for treatment of chemical pulp for the manufacturing of microfibrillated cellulose comprising the following steps:

a) providing a hemicellulose containing pulp,
b) refining said pulp in at least one step and treating said pulp with one or more wood degrading enzymes at a relatively low enzyme dosage, and
c) homogenizing said pulp thus providing said microfibrillated cellulose.

According to a second aspect of the invention a microfibrillated cellulose obtainable by the method according to the first aspect is provided. According to a third aspect of the invention, use of said microfibrillated cellulose according to the second aspect in food products, paper products, composite materials, coatings or in rheology modifiers (e.g. drilling muds) is provided.

BRIEF DESCRIPTION OF THE DRAWINGS

FIG. 1 is a photomicrograph from Cryo-TEM measurements of the thickness of the microfibrills.

DETAILED DESCRIPTION OF THE INVENTION

It is intended throughout the present description that the expression "refiner" embraces any apparatus capable of refining (beating) chemical pulp. Examples of beating apparatuses are beaters and refiners optionally equipped either with refining discs (disc refiners) or a refining plug in a conical housing (conical refiner), ball mills, rod mills, kneader pulper, edger runner and drop work. A beating apparatus may operate continuously or discontinuously.

The homogenization of said pulp of step c) may be performed using any apparatus, known for a person skilled in the art, suitable for homogenization of a pulp. For instance a high-pressure fluidizer/homogenizer may be used for the homogenization of said pulp of step c).

The chemical pulps that may be used in the present invention include all types of chemical wood-based pulps, such as bleached, half-bleached and unbleached sulphite, sulphate and soda pulps, kraft pulps together with unbleached, half-bleached and bleached chemical pulps, and mixtures of these. Preferably said pulp contains from about 5 to 20% of hemicellulose. The consistency of the pulp during manufacture of microfibrillated cellulose may be any consistency, ranging from low consistency through medium consistency to high consistency. The consistency is preferably from 0.4 to 10%, most preferred from 1 to 4%.

According to a preferred embodiment of the first aspect of the present invention there is provided a method wherein said pulp is a sulphite pulp. The pulp may consist of pulp from hardwood, softwood or both types. Preferably said pulp contains pulp from softwood. The pulp may also contain softwood of one kind only or a mixture of different softwood types. The pulp may e.g. contain a mixture of pine and spruce.

According to a preferred embodiment of the first aspect of the present invention there is provided a method wherein said enzyme is used at a concentration of from 0.1 to 500 ECU/g fibres, preferably from 0.5 to 150 ECU/g fibres, most preferred 0.6 to 100 ECU/g fibres, especially preferred from 0.75 to 10 ECU/g fibres.

According to a preferred embodiment of the first aspect of the present invention there is provided a method wherein said enzyme is a hemicellulase or a cellulase or a mixture thereof, preferably a mixture of culture filtrate type.

According to a preferred embodiment of the first aspect of the present invention there is provided a method wherein said enzyme is a cellulase, preferably a cellulase of endoglucanase type, most preferred a mono-component endoglucanase.

According to a preferred embodiment of the first aspect of the present invention there is provided a method wherein step b) comprises refining said pulp both before and after said enzyme treatment.

According to a preferred embodiment of the first aspect of the present invention there is provided a method wherein step b) comprises refining said pulp (only) before said enzyme treatment.

According to a preferred embodiment of the first aspect of the present invention there is provided a method wherein step b) comprises refining said pulp (only) after said enzyme treatment.

According to a preferred embodiment of the first aspect of the present invention there is provided a method wherein the first refining provides a pulp with a drainage resistance of from about 20 to about 35° SR and said second refining provides a pulp with a drainage resistance of above 70° SR.

As said above a further advantage of the method according to the first aspect of the present invention is that the energy consumption is lowered when manufacturing microfibrillated cellulose from pulp.

Preferred features of each aspect of the invention are as for each of the other aspects mutatis mutandis. The prior art document mentioned herein are incorporated to the fullest extent permitted by law. The invention is further described in the following examples in conjunction with the appended FIGURE which do not limit the scope of the invention in any way. Embodiments of the present invention are described in more detail with the aid of examples of embodiments and the FIGURE, the only purpose of which is to illustrate the invention and are in no way intended to limit its extent.

EXAMPLES

Example 1

Treatment of Sulphite Pulp with Enzyme and Refining Said Pulp

The cell wall delamination was carried out by treating the sulphite pulp in four separate steps.

1. A 4% w/w cellulose suspension (ECO Bright, from Domsjö Fabriker AB) was mechanically refined using an Escher-Wyss refiner (Angle Refiner R1L, Escher-Wyss) with 33 kWh/tonne at a specific edge load of 2 Ws/m to 28° SR. The pulp was a softwood pulp from a mixture of Norwegian Spruce and Scottish Pine (respectively 60%/40%). The pulp had been TCF-bleached in a closed loop bleach plant.
2. Four different amounts of monocomponent endoglucanase were added (Cases A, B, C and D) (Novozym 476, a cellulase preparation, from Novozymes A/S). In Case A no enzyme was added (0 ECU/g fibres). In case B, C and D, 100 grams (calculated as dry fibres) of refined pulp was dispersed in 2.5 litres of phosphate buffer (pH 7, final pulp concentration 4% w/w) with different amounts of enzymes (Case B=0.65 ECU/g fibres, Case C=0.85 ECU/g fibres, Case D=150 ECU/g fibres) and incubated at 50° C. for 2 hours. The samples were mixed manually every 30 minutes. Then the samples were washed with de-ionized water and the enzymes were then denaturated at 80° C. for 30 minutes. At the end, the pulp sample was washed with de-ionized water again.
3. The pre-treated pulps were refined once again with the Escher-Wyss refiner, to °SR-values (Shopper-Riegler) between 90 and 95 (average refining energy 90 kWh/tonne, specific edge load 1 Ws/m).
4. Subsequently, the material was passed through a high-pressure fluidizer/homogenizer (Microfluidizer M-110EH, Microfluidics Corp.). The 2% w/w concentration pulp fibre slurry was passed through two differently sized chamber pairs (each pair connected in series). First, the slurry passed three times through a chamber pair with a diameter of 400 μm and 200 μm (the first chamber and the second chamber, respectively), and then, 5 times through a chamber pair with a diameter of 200 μm and 100 μm. The operating pressures were 105 MPa and 170 MPa, respectively.

The material was also produced using different chambers and different number of passes through the chambers showing that, if the pre-treatment was done in a good fashion, these parameters (chamber type and number of passes) did essentially not matter. Two cases were tried (Cases E and F). In both these cases the production method was done according to Case C, with the exception of the choice of chambers and the number of passes.

In Case E the material was passed one time through a chamber pair with a diameter of 200 μm and 100 μm. The operating pressure was 170 MPa.

In Case F the material was passed one time through a chamber pair with a diameter of 400 μm and 200 μm. The operating pressure was 105 MPa.

TABLE 1

| Cases | Enzyme dosage [ECU/g fibres] | Results |
|---|---|---|
| A | 0 | Extensive clogging. Small amounts of material produced. |
| B | 0.65 | Extensive clogging. Small amounts of material produced. |
| C | 0.85 | No problems with clogging or production of material. |
| D | 150 | Clogging. Small amounts of material produced. Low homogenisation efficiency, e.g. less liberated surfaces. |
| E | 0.85 | No problems with clogging or production of material. |
| F | 0.85 | No problems with clogging or production of material. |

Further measurements were done which clearly indicates that the microfibrillated cellulose according to the second aspect of the present invention differs from the one described in U.S. Pat. No. 4,341,807 mentioned above. The microfibrillated cellulose according to the second aspect of the present invention has a much higher specific surface in comparison with the one described in U.S. Pat. No. 4,341,807, which is described in Journal of Applied Polymer Science (JAPS) below (ref. 1 and 2) and is therefore more reactive and more interesting for most of the practical applications thereof.

In JAPS the size (=the thickness of the microfibrills) is indicated to be between 25-100 nm (ref. 1 and 2). The microfibrillated cellulose according to the second aspect of the present invention has according to NMR-measurements an average thickness of 17.3+/−0.7 nm with CP/MAS 13C-NMR. The method for determining the thickness of the microfibrills is described in the publications 3 and 4 below. Cryo-TEM measurements (see FIG. 1) of the thickness, of the microfibrillated cellulose according to the second aspect of the present invention, give a range on this thickness of between 3.5 nm to 18 nm in comparison with 25-100 nm for the microfibrillated cellulose produced in accordance with U.S. Pat. No. 4,341,807. The electron microscope methods are directly comparable whereas NMR primarily appears to detect the big aggregates.

Various embodiments of the present invention have been described above but a person skilled in the art realizes further minor alterations, which would fall into the scope of the present invention. The breadth and scope of the present invention should not be limited by any of the above-described exemplary embodiments, but should be defined only in accordance with the following claims and their equivalents. For example, any of the above-noted methods can be combined with other known methods. Other aspects, advantages and modifications within the scope of the invention will be apparent to those skilled in the art to which the invention pertains.

LIST OF DOCUMENTS APPEARING IN THE DESCRIPTION

1. Herrick, F. W., R. R. Casebier, et al. (1983). "Microfibrillated Cellulose: Morphology and Accessibility." *Journal of Applied Polymer Science: Applied Polymer Symposium* (37): 797-813.
   . . . fibrils appear as rope-like bundles of partially embedded microfibrills having diameters of 25 to 100 nm . . . (page 803)
2. Turbak, A. F., F. W. Snyder, et al. (1983). "Microfibrillated Cellulose: A new Cellulose Product: Properties, Uses, and Commercial Potential." *Journal of Applied Polymer Science: Applied Polymer Symposium* (37): 815-827.

. . . At ×10,000 magnification, the predominant net-like structure of the product, after carbon dioxide critical point drying, contains microfibrils having diameters of 25-100 nm . . . (page 820)

Refers to U.S. Pat. No. 4,341,807, U.S. Pat. No. 4,374,702 and U.S. Pat. No. 4,378,381

3. Larsson, P.; Wickholm, K.; Iversen, T. Carbohydr. Res. 1997, 302, 19-25.

4. Wickholm, K.; Larsson, P.; Iversen, T. Carbohydr. Res. 1998, 312, 123-129, and U.S. Pat. No. 4,341,807

The invention claimed is:

1. A method of making microfibrillated cellulose, comprising:

a) providing a hemicellulose containing pulp, b) refining said pulp with a beating apparatus in at least one step and treating said pulp with one or more wood degrading enzymes at a concentration of from 0.1 to 10 ECU/g fibres, and c) homogenizing said refined pulp with a homogenizer to produce said microfibrillated cellulose.

2. The method according to claim 1, wherein said pulp is a sulphite pulp.

3. The method according to claim 1, wherein said enzyme is used at a concentration of from 0.75 to 10 ECU/g fibres.

4. The method according to claim 1, wherein said enzyme is a hemicellulase, a cellulase or a mixture thereof.

5. The method according to claim 4, wherein said enzyme is a cellulase.

6. The method according to claim 4, wherein said hemicellulase, cellulase or mixture thereof is obtained from a culture filtrate.

7. The method according to claim 4, wherein said cellulase is an endoglucanase.

8. The method according to claim 4, wherein said cellulase is a mono-component endoglucanase.

9. The method according to claim 1, wherein step b) comprises refining said pulp both before said enzyme treatment and after said enzyme treatment.

10. The method according to claim 9, wherein refining the pulp before the enzyme treatment provides a pulp with a drainage resistance of from 20° SR to 35° SR and refining the pulp after the enzyme treatment provides a pulp with a drainage resistance of above 70° SR.

11. The method according to claim 1, wherein step b) comprises refining said pulp before said enzyme treatment.

12. The method according to claim 1, wherein step b) comprises refining said pulp after said enzyme treatment.

13. The method according to claim 1, wherein the pulp is from softwood.

14. The method according to claim 1, comprising homogenizing said pulp with a high-pressure fluidizer/homogenizer to produce said microfibrillated cellulose.

15. The method according to claim 14, comprising homogenizing said pulp at a pressure of about 105 MPa to 170 MPa.

16. The method according to claim 15, wherein homogenizing said pulp comprises passing the pulp through one or more chamber having a diameter of 400 μm or less.

17. The method according to claim 15, wherein homogenizing said pulp comprises passing the pulp through at least one chamber having a diameter of 100 μm.

18. The method according to claim 1, wherein the microfibrillated cellulose comprises microfibrils having a thickness of 3.5 to 18 nm.

19. A method of making microfibrillated cellulose, comprising:

providing a pulp material comprising hemicellulose;

refining the pulp with a beating apparatus;

treating the pulp with cellulase at a concentration of from 0.1 to 10 ECU/g of fibers; and homogenizing the cellulase treated pulp with a high-pressure fluidizer/homogenizer, wherein the cellulase treated pulp is passed through at least one chamber having a diameter of 200 μm or less, at a pressure of about 105 MPa to 170 MPa, producing microfibrils having a thickness of 3.5 to 18 nm.

* * * * *

UNITED STATES PATENT AND TRADEMARK OFFICE

CERTIFICATE OF CORRECTION

PATENT NO. : 8,546,558 B2
APPLICATION NO. : 12/161463
DATED : October 1, 2013
INVENTOR(S) : Ankerfors et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1143 days.

Signed and Sealed this
Fifteenth Day of September, 2015

Michelle K. Lee

Michelle K. Lee
*Director of the United States Patent and Trademark Office*